United States Patent [19]

Huang

[11] Patent Number: 4,985,300

[45] Date of Patent: Jan. 15, 1991

[54] SHRINKABLE, CONFORMABLE MICROWAVE WRAP

[75] Inventor: Hua-Feng Huang, Mendenhall, Pa.

[73] Assignee: E. I. du Pont de Nemours and Company, Wilmington, Del.

[21] Appl. No.: 291,213

[22] Filed: Dec. 28, 1988

[51] Int. Cl.[5] ..... B32B 15/08; B32B 27/32; B32B 27/36

[52] U.S. Cl. ..... 428/332; 426/392; 428/349; 428/457; 428/458; 428/461; 428/480; 428/500

[58] Field of Search ..... 428/457, 341, 458, 461, 428/403, 332, 480, 500, 349; 156/212; 264/289; 426/589, 392; 219/10.55

[56] References Cited

U.S. PATENT DOCUMENTS

| | | | |
|---|---|---|---|
| 2,951,246 | 8/1960 | Halpern et al. . | |
| 4,020,141 | 4/1977 | Quinn et al. | 264/289 |
| 4,267,420 | 5/1981 | Brastad | 219/10.55 |
| 4,407,685 | 10/1983 | Hankland | 156/212 |
| 4,492,730 | 1/1985 | Oishi et al. | 428/458 X |
| 4,559,266 | 12/1985 | Misasa et al. | 428/341 |
| 4,624,865 | 11/1986 | Gindrup et al. | 428/403 X |
| 4,641,005 | 2/1987 | Seiferth | 219/10.55 |
| 4,713,510 | 12/1987 | Quick et al. | 219/10.55 |
| 4,803,088 | 2/1989 | Yamamoto et al. | 426/589 X |

FOREIGN PATENT DOCUMENTS 51-102072 9/1976 Japan .

*Primary Examiner*—Thomas J. Herbert

[57] ABSTRACT

A heat shrinkable film is useful for packaging and for cooking a food item in a microwave oven is provided, which comprises a layer of flexible, heat resistant, microwave transparent base film which exhibits shrinkage of at least about 10% when heated unrestrained to 100° C. for 5 seconds, and a layer of microwave susceptor material extending over the base film in an amount sufficient to cause the film to heat under microwave cooking conditions to provide browning or crisping of the food item.

15 Claims, 1 Drawing Sheet

SHRINKABLE, CONFORMABLE MICROWAVE WRAP

BACKGROUND OF THE INVENTION

This invention relates to packaging materials and structures used in microwave cooking, and specifically to microwaveable packaging of food items which require surface browning and/or crisping during cooking.

There has been much interest recently in packaging materials which aid in browning and crisping of food items in a microwave oven. U.S. Pat. No. 4,267,420, Brastad, discloses a food item wrapped with plastic film having a very thin coating thereon. An additional sheet or film of plastic is optionally laminated to the coating for abrasion protection. Other exterior support by more rigid dielectric materials such as paperboard and the like is also disclosed. The coating converts some of the microwave energy into heat which is transmitted directly to the surface portion of the food so that a browning and/or crisping is achieved.

U.S. Pat. No. 4,641,005, Seiferth, discloses a disposable food receptacle for use in microwave cooking, which includes a provision to brown the exterior of the food in the receptacle. A thin layer of an electrically conductive material is incorporated into the receptacle on the food contacting surfaces thereof, so that the conductive layer will become heated by the microwave radiation and will, in turn, brown the exterior of the food in the receptacle. The receptacle includes a smooth surfaced plastic film, as a protective layer, and a support means formed of paper stock material.

U.S. Pat. No. 4,713,510, Quick et al., discloses a microwave ovenable package including a layer of material that will convert a portion of the microwave energy to heat and a layer of paperboard interposed between the energy-converting layer and the food. The energy-converting layer may be carried on a plastic film, and an additional layer of paperboard may be used to sandwich the energy-converting layer and the plastic film between layers of paperboard. For the purpose of providing a more intense heating effect, two energy-converting layers, each on a dielectric substrate, sandwiched together between layers of paperboard, are disclosed.

Laminates of plastic films with thick layers of vacuum deposited metal are also known as packaging materials. For Example, U.S. Pat. No. 4,559,266, Misasa et al., discloses a laminated material comprising (A) a layer composed mainly of polyolefin, (B) a layer composed mainly of, e.g., polyester resin, (C), a metal-vacuum deposited layer, and (D) a layer composed mainly of a transparent thermoplastic resin. This laminated material is used for its superior gas barrier properties and light shielding properties, etc. Such laminates, in order to provide significant gas barrier properties for packaging applications, require deposition of metal (typically aluminum) in sufficient amounts to impart optical densities of greater than 1.0, typically at least 4.0. Such materials are substantially opaque and have light shielding properties, but are not suited for use for microwave heating applications, for which much lower optical densities are required.

Japanese patent application Ser. No. 51 102 072, Mitsubishi, discloses a thermally contractable metal vapor deposited thermoplastic film. A layer of metal, typically 40 millimicrons of aluminum is deposited on the film, which has first been stretched under ordinary conditions. The film is thereafter further stretched in the same direction as previous stretching at 2-25%. After treatment with an anchoring reagent, the film is further stretched. The resulting film has excellent luster and is useful as labels for cans and bottles.

In order to properly brown or crisp foods which are irregular in shape or which have nonplanar surfaces, it is desirable to have a packaging material which is readily conformable to the food. It is also desirable that the material supply enough heat energy to the surface of the food, and provide some degree of microwave shielding for the interior of the food so that the surface can be properly browned or crispened in a short time without the interior becoming overcooked. The present invention provides a film which conforms closely to the shape of a food item by means of shrinking both before and during cooking, provides a high degree of heat to the surface of the food, and provides shielding to the interior portion of the food.

SUMMARY OF THE INVENTION

The present invention provides a heat shrinkable film useful for packaging and for cooking in a microwave oven of at least one food item which requires surface browning or crisping, comprising at least one layer of flexible, heat resistant, microwave transparent base film which exhibits shrinkage of at least about 10% when heated unrestrained in oil to 100° C. for 10 seconds, and at least one layer of microwave susceptor material extending over at least a portion of the base film and present in an amount sufficient to cause the film to heat under microwave cooking conditions to a temperature suitable for browning or crisping of a food item placed adjacent thereto.

The present inventions also provides a process for preparing a package for cooking at least one food item in a microwave oven, comprising the steps of selecting a film comprising at least one layer of flexible, heat resistant, microwave transparent base film which exhibits shrinkage of at least about 10% when heated unrestrained in oil to 100° C. for 10 seconds, and at least one layer of microwave susceptor material extending over at least a portion of the base film and being present in an amount sufficient to cause the film to heat under microwave cooking conditions to a temperature suitable for browning or crisping of a food item placed adjacent thereto; wrapping said film about said food item; and securing said film in its wrapped conformation. The film can be heated to a temperature sufficiently high that the film shrinks, so that it conforms securely to the contours of the food item but still retains shrinkage sufficient for further conformity during microwave cooking. The invention also includes the package for containing the food item.

DETAILED DESCRIPTION OF THE INVENTION

Figure 1:
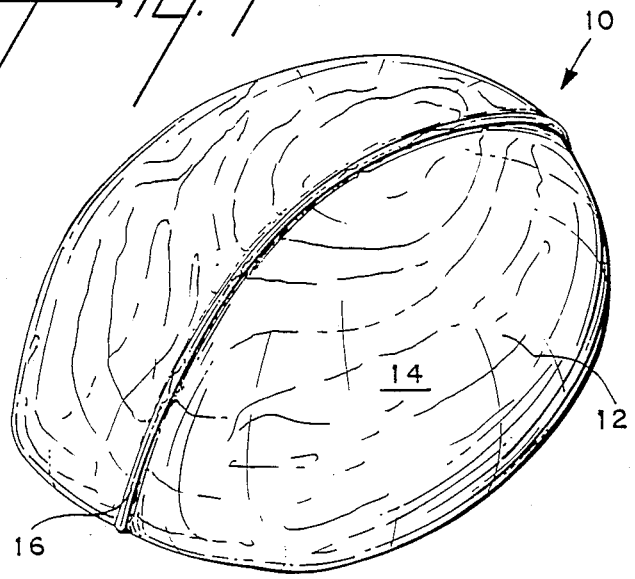
FIG. 1 shows a food item such as a roll, wrapped in a shrink film of the present invention.

The film used to make the packages of the present invention is a shrink film which has been coated with a microwave susceptor material. The shrink film can be prepared from any material which provides a film exhibiting shrinkage of at least about 10%, preferably at least about 20%, and most preferably at least about 45% when heated unrestrained to 100° C. for 10 seconds. (Depending on the treatment and coatings optionally applied to such film, the final product may exhibit somewhat less shrinkage.) The film should also have sufficient heat stability to withstand the temperatures encountered during microwave cooking while substantially retaining its structural integrity. The preferred shrink film for this application is prepared from polyethylene terephthalate (PET). Such shrink film is described in more detail in U.S. Pat. No. 4,020,141, the disclosure of which is incorporated herein by reference. Other suitable shrink films include those made from PET copolymers including a second glycol or a second acid, other polyesters, and polyolefins such as polyethylene. The polyester films are preferred because of their superior high temperature properties. Typical shrink films based on PET will exhibit about 45% shrinkage in the machine direction and 50% shrinkage in the transverse direction when subjected to 100° C. water for 5 seconds.

The shrink film is provided with a microwave susceptive material in the form of a coating or layer which extends over at least a portion of its surface. The coating may be of any material suitable for conversion of at least a portion of incident microwave radiation to heat. For example, the susceptive material can be in the form of a coating of (i) about 5 to 80% by weight of metal or metal alloy susceptor in flake form, embedded in (ii) about 95 to 20% by weight of a thermoplastic dielectric material. More preferably the relative amount of such susceptor will be about 25 to 80% by weight, and most preferably about 30 to 60% by weight. A coating thicknesses of about 0.01 mm to about 0.25 mm (about 0.4 to 10 mils) is suitable for many applications. The surface weight of such a susceptor coating on the substrate is from about 2.5 to 100 $g/m^2$, preferably about 10 to about 85 $g/m^2$.

Suitable thermoplastic dielectric materials in which the susceptor flake may be embedded include, but are not limited to, polyesters selected from the group consisting of copolymers of ethylene glycol, terephthalic acid, and azelaic acid; copolymers of ethylene glycol, terephthalic acid, and isophthalic acid; and mixtures of these copolymers.

Suitable susceptor flake materials for use in this embodiment of the invention include aluminum, nickel, antimony, copper, molybdenum, iron, chromium, tin, zinc, silver, gold, and various alloys of these metals. Preferably the susceptor flake material is aluminum. The flakes of the susceptor should have an aspect ratio of at least about 10, and will preferably have a diameter of about 1 to about 48 micrometers and a thickness of about 0.1 to about 0.5 micrometers. In order to obtain uniformity in heating, it is preferred that the flakes be approximately circular, having an ellipticity in the range of about 1:1 to 1:2. Alternatively, the flakes, if not circular, can be applied to the film in two or more separate passes, which also provides an improvement in the degree of uniformity of heating. Films prepared from such material will typically have a surface resistance of at least $1\times10^6$ ohms per square (ASTM D257) and are normally optically opaque. Such films are described in more detail in copending U.S. application Ser. No. 002,980, filed Jan. 20, 1987, the disclosure of which is incorporated herein by reference.

Alternatively, the base film can be coated with a thin layer of susceptor material by vacuum deposition techniques. In this embodiment, the susceptor material can be a substantially continuous electrically conductive material which is present in sufficient thickness to cause the multilayer structure to heat under microwave cooking conditions to a temperature suitable for browning or crisping of food placed adjacent thereto, but not so thick as to completely prevent penetration of microwave energy to the interior of the food. Preferred susceptor materials include vacuum metallized aluminum and vacuum sputtered stainless steel, type 304. Such susceptors will preferably be present in sufficient amounts exhibit a resistivity of about 60 to about 1000 ohms per square, preferably about 100 to about 600 ohms per square. Other metals, of course, may be used, including gold, silver, mu-metal, nickel, antimony, copper, molybdenum, bronze, iron, tin, and zinc. Other materials can also be used, including conductive carbon, semiconductive materials such as silicon carbide, and various glassy metal oxides, such as $In_2O_3$:$SnO_x$, $In_2O_3$:Sn, $RuO_2$, $MoO_2$, $TaO_2$, $CuO_2$, $ZnO_x$, $CdO_x$, $BO_x$, or Ag-AgO-Ag. The latter is a silver-silver oxide-silver "sandwich" which uses the oxygen barrier properties of the silver oxide to protect the layer of silver from oxidation. Similarly, if an easily oxidized metal such as aluminum is used, it should be protected, preferably by covering with a protective layer of amorphous polyester or other suitable material such as polyethylene. Methods other than vacuum deposition may also be used if they provide a substantially continuous layer of the desired thickness and microwave activity.

The amount of susceptor material applied to the film, whether metal flake, continuous metallized layer, or other material, may be varied within certain limits which will be apparent to one skilled in the art. The test to determine the correct amount of material is whether the coating will heat to the proper temperature and provide sufficient heat flux for browning or crisping of food items. The required temperature may depend on the particular food item used but for many applications generally about 150° C.

The method of applying the microwave susceptor coating must be one which does not expose the shrink film to high temperatures; otherwise the film will shrink during processing. For vacuum deposition and R. F. sputtering processes, this may be accomplished by providing the film with a water-cooled support plate or drum and limiting the rate of deposition by shuttering the deposition on and off. Alternatively, magnetron sputtering can be used. Concerns about shrinkage do not normally arise if inherently cool processes are used to minimize heating of the substrate, such as solvent coating, printing, or electroless plating.

Figure 2:
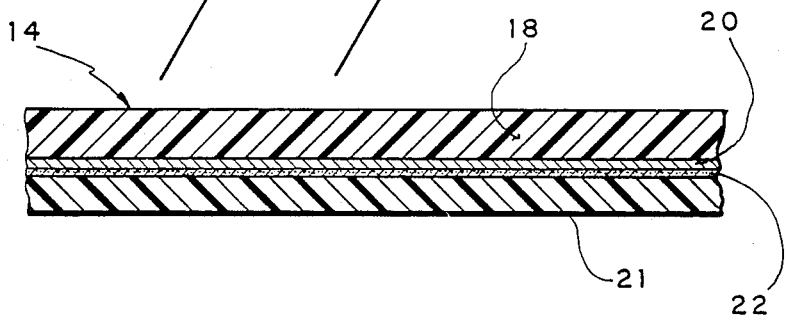
FIG. 2 shows in cross section a film of the present invention.
Figure 3:
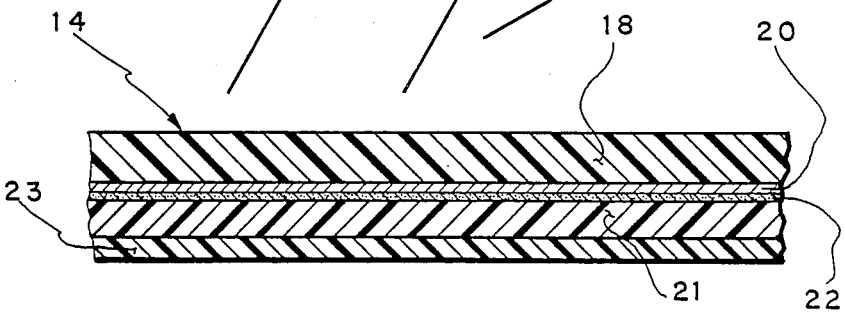
FIG. 3 is a cross section of an alternative embodiment of the invention.

A typical film, 14, of the present invention is shown in cross section in FIG. 2. Layer 18 is the heat shrink base film, which carries microwave susceptor layer 20. The dimensions in this figure are not drawn to scale; in particular if the microwave susceptor layer 20 is a continuous thin layer of metal, it will be much thinner than is illustrated. Layer 21 is an optional protective layer, and layer 22 is a separate layer of adhesive for holding layer 21 to susceptor layer 20. Layer 23 in FIG. 3 is an optional heat sealable material as described below.

Film 14 is employed by wrapping and sealing it about a food item. The film will preferably be wrapped in such a way as to avoid direct exposure of the food item to the microwave susceptor material. Thus if there is no protective layer atop the susceptor layer, the susceptor will normally be situated facing away from the food item. The film is wrapped about the food item and then sealed into its wrapped configuration. Sealing can be by any suitable means which will provide a seal strong enough to withstand the force generated by shrinkage of the film. Various methods may be used for sealing, such as a heat sealable material comprising a layer extending over at least a part of the surface of the film. A suitable heat sealable material is prepared from polymers selected from the group consisting of copolymers of ethylene glycol, terephthalic acid and azelaic acid; copolymers of ethylene glycol, terephthalic acid, and isophthalic acid; and mixtures of the polymer. The preferred method of sealing is by hot wire sealing. This process characteristically involves the use of a web-fed device in which a plastic web is folded lengthwise over spaced items to be packaged and fed stepwise under a head carrying an L-shaped hot wire. In operation the wire moves down to seal and cut the leading edge and the trailing edge of the web to form a package. Such a device may typically operated either automatically or manually. FIG. 1 illustrates a sealed package, 10, so prepared, containing a food item 12, such as a roll. film, 14 is wrapped about the food item and is secured by means of a hot wire seal, 16. Excess flaps of film have been removed during the hot wire sealing process.

After sealing, the wrapped film can be preshrunk to conform to the shape of the food item. Such shrinking can be done by conventional heating means as in a heat shrink oven or, in hand preparation, by a hot air blower. This treatment provides a snug package which may be desirable for shipping or storage purposes. Preshrinking is not essential, however, since upon heating in a microwave oven the film will shrink to conform to the contours of the food item. A package can be formed and the preshrinking step carried out in such a way that the film retains about 10 percent residual shrinkage. Shrinkage ensures close conformity between the film and the food item during the subsequent microwave cooking process. Control of residual shrinkage when preshrinking is used is effected by controlling time at temperature, as is known. If it is desired that all the shrinkage occur during microwave cooking, the package is formed about the food with adequate space allowed so that upon heating, the package will initially shrink to conform to the food item with an additional part of the shrinkage retained to maintain conformity with the food throughout the cooking process. This is achieved by appropriate selection of the size of the initial package in relation to the size of the food item and can be readily determined by simple experimentation.

The sealed package may be made airtight but ordinarily is provided with vents before cooking. For many applications the presence of vents is important in order to provide escape for steam generated during the cooking process. Such vents can include slits, holes, spaces left in a seam, or pinholes formed during the film manufacturing or packaging process or holes, flaps, or the like to be opened by the consumer prior to cooking. Alternatively, the consumer may be directed to cut vents before cooking.

The package of the present invention is suitable for microwave cooking of a variety of food items, particularly those items which require browning or crisping of the surface during such cooking. Examples of such foods include bread products, meat and poultry products, egg rolls, potato products, and the like. Such materials are not simple shapes that can be wrapped with a flexible but planar film so that the entire surface is intimately contacted. Furthermore, during cooking the food may alter its shape in a manner that breaks contact with an encompassing wrap. The shrinkable film of the present invention eliminates many of these problems. The heat generated by the susceptor material in the film, in combination with the heat generated from the cooking of the food item, is sufficient to cause the film to shrink in situ to retain a snug fit around the food item during the cooking process.

Since a susceptor film, by itself, can attain a very high temperature in a microwave oven in a matter of seconds, such films may melt or otherwise be damaged in localized regions if an adequate heat sink is not provided. The most important heat sink in packages of the present invention is the food item itself. By providing proper, close contact with the food, therefore, the shrinkage of the film performs two important functions. Not only does it maintain adequate overall surface heating of the food item, but it also assures that the film will not be isolated from the heat sink and thus be subject to overheating.

EXAMPLES 1-3

In order to evaluate the effect of metallizing on the shrink properties of film, three samples of shrink film were prepared by vacuum deposition of 304 stainless steel onto PET shrink film. The particular PET shrink film was Type 65 HS Mylar ®which is formed from a composition of PET containing a minor amount of diethylene glycol and azelaic acid components, and having a softening point of about 215°-230° C. and a melting point above 250° C. The film had a final thickness of 16.5 micrometers (65 gauge) and had been oriented by stretching about 2.5-3.6 X in the machine direction and about 2.9 to 4.0 X in the transverse direction, as described in more detail in U.S. Pat. No. 4,020,141. Samples of this film were metallized by a low temperature sputtering process (type 304 stainless steel by magnetron sputtering) while keeping the film at a low temperature by backing the target film area with a water-cooled substrate supporting plate and by shuttering the deposition on and off. The amount of metal deposited was reported by the vendor in terms of the surface resistivity of the film, ohms/square. Shrinkage parameters in the machine direction (MD) and transverse direction (TD) were evaluated by immersion in oil at 100° C. for 10 seconds and comparing lengths before and after treatment, for shrinkage, and ASTM D2838-81, for shrink tension. The results are shown in Table I, along with published values for shrinkage of the untreated film (reference).

TABLE I

Shrinkage of Polyester Shrink Film with SS 304

| Example | Resistance ohms/square | % Shrinkage MD | % Shrinkage TD | Shrink Tension g/cm MD | Shrink Tension g/cm TD |
|---|---|---|---|---|---|
| 1 | 500 | 51 | 52 | 183 | 361 |
| 2 | 250 | 49 | 53 | 200 | 429 |
| 3 | 125 | 50 | 56 | 236 | 488 |
| ref. | — | 45* | 50* | — | — |

*Average measurements using 100° C. water for 5 sec.

It is seen from these examples that coating with metal at these levels results in films which retain their shrinkage properties.

EXAMPLE 4

Rye rolls, 360 to 370 g each, about 27 hours out of hearth, having 6% moisture in the crust and 30% moisture in the interior, were individually shrink wrapped about one hour later by sealing each roll inside a film pouch and shrinking using a Shanklin TM tunnel at about 193° C. at 55% belt speed, to shrink the film tightly about the roll. The film used was similar to that of Examples 1–3 but had been treated by sputtering with aluminum to about 125 ohm/square. This film was sufficiently transparent to permit the bread inside to be seen. The packages were stored for three days at room temperature. One package, a control which had been left in its original baker's polyethylene wrapper, was then opened. The roll was soggy. The unopened package was placed in a 700W microwave oven on a turntable and cooked, vented, at full power for 55 seconds. After cooking, the package retained its seal intact and was as transparent, by visual inspection, as when it was first prepared. After the package was opened, the bread was found to be satisfactory, with a crisp, darkened crust. For comparison, the soggy roll, from the control package, was cooked uncovered under the same conditions. The resulting roll was not crispy. Another roll was wrapped as above but in film metallized with 125 ohms/square type 304 stainless steel. The roll, originally frozen, was defrosted for 2.5 hours under ambient conditions, leaving the center still frozen. The wrapped roll was cooked in a 700 watt oven on a ribbed glass tray with the package vented by three holes. After four minutes the sides were crusty.

EXAMPLE 5

A number of samples of rolls were cooked in a 700 watt microwave oven with the results as indicated in Table II, below. The preshrunk film samples were made in a Shanklin TM heat tunnel at 166° C. and sealed with a Shanklin TM L-Sealer (wire sealer). A small vent was provided to shrink wrap, which was covered with a metallized label to insure good shelf life. This hole was not uncovered. The test shows that a particularly good result can be obtained using a film of 125 ohm/square, a properly selected cooking time, with resistance of the product to crushing matched to the residual shrinkage of the film.

TABLE II

| Run | Susceptor[1] | Ohms/sq. | Time (sec) | Remarks & Results |
|---|---|---|---|---|
| a | No wrap | — | 50 | Control. Crust soft, Middle OK |
| b | No wrap | — | 60 | Control. Soft. No crisping. Inside overcooked. |
| c | SS/65HS preshrunk | 500 | 50 | Vents cut. Crust soft. Inside OK. |
| c | SS/65HS preshrunk | 500 | 60 | Crust soft, crinkled. Inside overcooked. |
| e | SS/65HS preshrunk | 500 | 65 | Vents cut. Bread shrunk. Slightly overcooked. |
| f | SS/65HS not preshrunk | 500 | 75 | Bread shrunk, overcooked, tough, dry. Uneven film shrinkage. |
| g | SS/65HS preshrunk | 250 | 60 | Vents cut. Metal crazed. Slightly crisp on side; crinkled. |
| h | SS/65HS preshrunk | 250 | 65 | Vents cut. Crust crisp crinkled. Inside OK, slightly tough. |
| i | SS/65HS not preshrunk | 250 | 65 | Vents cut. Bread compressed, shrivelled, overcooked. |
| j | SS/65HS preshrunk | 125 | 60 | Vents cut. Corner burned. Crust crisp. Slight shrivel. Inside fine. |
| k | SS/65HS preshrunk | 125 | 50 | Vents cut. Crust crisp. Inside fine. |
| l | SS/65HS not preshrunk | 125 | 50 | Vents cut. Compressed. Tough, overcooked. |

[1]Susceptor SS/65HS is Mylar ® 65 HS heat shrink film with a coating of type 304 stainless steel of the indicated resistivity.

EXAMPLE 6

A frozen egg roll, La Choy TM Egg Roll Entree, Almond Chicken (from Beatrice/Hunt-Wesson, Inc., Fullerton, CA 92634) was heat sealed in a pouch of the film of Example 1 with a vent hole cut in one corner. It was heated in the microwave oven of Example 5 for 3 minutes at high power. During the course of cooking, the pouch collapsed around the egg roll. Upon opening the pouch, the egg roll was found to be done and reasonably crisped over a significant portion of its exterior.

EXAMPLE 7

Film was prepared from heat shrinkable polyethylene terephthalate film similar to the film of Example 1, having a thickness of 20.3 micrometers (80 gauge). To this film was applied a layer of aluminum flake, 50% by weight in a coating matrix. The coating matrix was prepared by combining 15.8 parts by weight of the copolymer condensation product of 1.0 moles ethylene glycol with 0.53 moles terephthalic acid and 0.47 moles azelaic acid, with 0.5 parts by weight of erucamide and 58 parts by weight of tetrahydrofuran. This mixture was placed in a heated glass reactor vessel equipped with a paddle stirrer. After dissolving the solids at 55., 0.5 parts by weight of magnesium silicate and 25 parts by weight of toluene were blended in. Three thousand grams of this solution were mixed with 640 g of aluminum paste (70% aluminum solids in mineral spirits), commercially available as "Sparkel Silver TM," type 3641, from Silberline Manufacturing Company.

The coating solution was dispersed, using two passes, on a 280 mm wide doctor roll coater to obtain, after drying, a coating thickness of approximately 0.02 mm (0.8 mil). The total dry coating weight was approximately 30 g/m$^2$ Due to losses and retained mineral spirits, the final concentration of aluminum on the film was 11 g/m$^2$. The total thickness of the coated film was 40.6 micrometers (160 gauge).

The coated film thus prepared was laminated to soft tissue-grade paper using a rice adhesive made by crushing steamed rice to a fine paste, and a pouch was formed by folding and sealing with the aforementioned polyimide tape.

EXAMPLE 8

A film was prepared as in Example 7, but without lamination to paper. The film was wrapped around a breaded chicken leg and sealed with polyimide based high temperature tape (available from the 3 M Company). The film was shrunk about the chicken leg by use of the heat from a hair dryer. The package was instrumented with Luxtron TM temperature probes and heated in a 700 watt microwave oven. The internal temperature of the leg at the thin end reached 100° C. in about 40 seconds, and at the thick end in about 95 seconds.

EXAMPLE 9

A film was prepared as in Example 8, the shrinkable PET base being 20 micrometers thick and having an aluminum containing coating about 20 micrometers thick. A piece of the film was wrapped around an onion-flavored bagel, and the edges and center of the film were sealed with an ultrasonic sealer. The film was then preshrunk with a hot air gun. The wrapped bagel was put into a 700 W microwave oven atop an inverted paper plate on a turntable, and cooked at high power for 60 seconds. The bagel was unwrapped, rewrapped in a paper towel, and allowed to stand for 5 minutes. The resulting product had fairly well distributed crustiness of the skin. The interior was very moist and the onion flavor was good.

EXAMPLE 10

Example 9 was repeated, except that the film package was not preshrunk before cooking. Upon heating in the microwave oven, the film wrap shrank tightly about the bagel, which was satisfactorily browned and crisped. Bagels of this example were compared with an unwrapped bagel which was cooked for 60 seconds. The unwrapped bagel did not have a crisp skin. A wrapped bagel, microwave cooked for 60 seconds and allowed to stand for 5 minutes was satisfactory. A wrapped bagel cooked for 90 seconds and allowed to stand for only 2 seconds exhibited the characteristic skin blistering of a freshly baked and toasted bagel.

EXAMPLE 11

Example 10 was repeated using, however, a film prepared from 16.5 micrometer (65 gauge) polyester terephthalate shrink film coated with vacuum sputtered type 304 stainless steel. The resulting product was browned and crisped, although not as fluffy as that of Example 10.

I claim:

1. A heat shrinkable film useful for packaging and for cooking in a microwave oven of at least one food item which requires surface browning or crisping, comprising (a) at least one layer of flexible, heat resistant, microwave transparent base film which exhibits shrinkage of at least about 10% when heated unrestrained to 100° C. for 5 seconds, and (b) at least one partially transmissive layer of microwave susceptor material extending over at least a portion of the base film and present in an amount sufficient to cause the film to heat under microwave cooking conditions to a temperature suitable for browning or crisping of a food item placed adjacent thereto.

2. The heat shrinkable film of claim 1 wherein the base film exhibits shrinkage of at least about 45% when heated unrestrained to 100° C. for 5 seconds.

3. The heat shrinkable film of claim 1 wherein the base film is selected from the group consisting of polyester films and polyolefin films.

4. The heat shrinkable film of claim 2 wherein the base film is polyethylene terephthalate.

5. The heat shrinkable film of claim 1 wherein the susceptor material is a substantially continuous layer of metal of appropriate thickness to cause the film to heat.

6. The heat shrinkable film of claim 5 wherein the thickness of the layer of metal is sufficient to provide a resistivity of about 100 to about 600 ohms/square.

7. The heat shrinkable film of claim 5 wherein the thickness of the layer of metal is sufficient to provide a resistivity of about 60 to about 1000 ohms/square.

8. The heat shrinkable film of claim 7 wherein the metal is stainless steel.

9. The heat shrinkable film of claim 7 wherein the metal is aluminum.

10. The heat shrinkable film of claim 9 further comprising a protective layer of film overlying the layer of aluminum.

11. The heat shrinkable film of claim 1 wherein the susceptor material is a flake material.

12. The heat shrinkable film of claim 11 wherein the flake material is embedded within a layer of thermoplastic material.

13. The heat shrinkable film of claim 12 wherein the flake material is aluminum flake.

14. The heat shrinkable film of claim 1 further comprising a layer of heat sealable material extending over at least a part of the surface of the film.

15. The heat shrinkable film of claim 14 wherein the heat sealable material is prepared from polymers selected from the group consisting of copolymers of ethylene glycol, terephthalic acid and azelaic acid; copolymers of ethylene glycol, terephthalic acid, and isophthalic acid; and mixtures of these copolymers.

* * * * *